US005166468A

United States Patent [19]

Atkeson

[11] Patent Number: 5,166,468

[45] Date of Patent: Nov. 24, 1992

[54] THERMOCOUPLE-TRIGGERED IGNITER

[75] Inventor: Peter L. C. Atkeson, Elkton, Md.

[73] Assignee: Thiokol Corporation, Ogden, Utah

[21] Appl. No.: 681,103

[22] Filed: Apr. 5, 1991

[51] Int. Cl.[5] ..... F42C 11/00; F42B 39/20

[52] U.S. Cl. ..... 102/207; 102/481

[58] Field of Search ..... 102/207, 202.5, 202.7, 102/205, 206, 218, 220, 481; 60/254

[56] References Cited

U.S. PATENT DOCUMENTS

| | | | |
|---|---|---|---|
| 3,038,303 | 6/1962 | Gose | 60/254 |
| 3,052,091 | 9/1962 | D'Ooge | 60/254 |
| 3,167,910 | 2/1965 | Weaver | 60/219 |
| 3,323,459 | 6/1967 | Buffet | 102/207 |
| 3,946,674 | 3/1976 | Pettersson et al. | 102/207 |
| 3,946,675 | 3/1976 | Stalfors | 102/207 |
| 4,421,029 | 12/1983 | Wich | 102/207 |
| 4,458,482 | 7/1984 | Vetter et al. | 102/481 |
| 4,478,151 | 10/1984 | Vetter et al. | 102/481 |
| 4,700,629 | 10/1987 | Benson et al. | 102/201 |
| 4,708,060 | 11/1987 | Bickes, Jr. et al. | 102/202.5 |

*Primary Examiner*—Charles T. Jordan
*Attorney, Agent, or Firm*—Cushman, Darby & Cushman

[57] ABSTRACT

An igniter which is triggered by a thermocouple for detonating an explosive material for forming an opening in a rocket motor case to render it non-propulsive in the event of a fire dangerously close thereto or for any other suitable purpose. The bridge therefor is preferably a suitable semiconductor bridge for handling a reduced amount of electrical energy which may be provided by the thermocouple. The thermocouple may be a plurality of pairs of dissimilar metal layers or foils alloyed together and the pairs connected in series.

16 Claims, 1 Drawing Sheet

THERMOCOUPLE-TRIGGERED IGNITER

The present invention relates generally to igniters.

As used herein and in the claims the term "igniters" meant to refer to any type of device wherein a pyrotechnic material is ignited for any purpose such as for igniting propellant material in a rocket motor, igniting any kind of explosive charge, or for igniting gas generant pellets in an automobile gas bag inflator. The term "igniter" is also meant to refer to an initiator for an igniter for such a device.

Various types of igniters are known wherein a bridge wire is placed in intimate contact with a quantity of pyrotechnic material, and the electrical energy from batteries, photovoltic cells, or other sources which require electrical communication with an external environment is passed through the bridge wire to heat it sufficiently to initiate burning of the pyrotechnic material. The hot gases from the burning of the pyrotechnic material are then commonly caused to, for example, ignite propellant material for propulsion of a rocket motor, ignite pellets for generation of gas for expanding an automobile gas bag, or for detonating an explosive device. U.S. Pat. No. 4,708,060 to Bickes, Jr. et al discusses various such igniters of the prior art and discloses a number of references thereto U.S. Pat. No. 4,700,629 to Benson et al discloses an optically-energized explosion initiating device.

While conventional small gage bridge wires have generally been found to be satisfactory for igniting the pyrotechnic material, such bridge wires consume a large quantity of electrical energy, for example, 30 millijoules or more, thus requiring high power electrical energy sources Bickes, Jr. et al discloses a semiconductor bridge device which when activated by a relatively low voltage pulse, i.e., on the order of about 20 volts, of relatively short duration, perhaps less than 0.2 seconds, effects a flow of electrons in a gap or bridge, provided by semiconducting material, between two conducting members wherein a plasma consisting of ionized atoms of the semiconducting material is formed which then interacts with a pyrotechnic or explosive material which is disclosed as being in intimate contact therewith such that the pyrotechnic material is ignited. A feature of this semiconductor bridge is that it has a lower energy requirement than conventional bridge wires, i.e., it may require perhaps only 1 to 5 millijoules or less excitation energy, which represents only 3% to 10% as much electrical energy as required by conventional bridge wires. Bickes, Jr. et al discloses its use with digital electronics such as other semiconductor components such as logic circuits, e.g., safing logic, fire sets, switching circuits, and the like. Since such power sources are subject to being mistakenly armed, it is desired to provide a power source which is dependent for firing on the desired condition for such firing so that it is not subject to such arming mistakes.

The case of a rocket motor is conventionally filled with a rapid burning propellant material which, upon ignition, produces gases which are released through the nozzle producing thrust When exposed to hazards such as a fuel fire or slow cook-off, the propellant material may be prematurely ignited, and the danger is greatly increased if the rocket motor becomes propulsive as a result. Various safety devices have been proposed for rendering a rocket motor non-propulsive in case of fire. For example, U.S. Pat. No. 4,458,482 to Vetter et al discloses a bare patch in an insulating coating on a cylinder which is shaped to reinforce stress patterns to cause failure at a predetermined point In accordance with U.S. Pat. No. 3,887,991 to Panella, a wire is used to connect a rocket motor closure to the case thereof and is fastened with an aluminum locking clip. If the rocket motor is subjected to an accidental external heat source of sufficient intensity, the aluminum locking clip fails and the wire springs outwardly freeing the closures from the rocket motor case thus making the rocket motor non-propulsive.

U.S. Pat. No. 3,613,374 to Ritchey discloses a nozzle which is removed by means of a mechanical device actuated by a squib which contains an electrically or otherwise ignited explosive charge. Other thrust termination devices are disclosed in U.S. Pat. Nos. 3,167,910 to Weaver, 3,038,303 to Gose, and 3,052,091 to D'ooqe.

The safety devices as discussed above are either unduly complicated or unsuitable for reliably and effectively rendering a rocket motor non-propulsive in case of a fire or slow cook-off.

It is therefore an object of the present invention to automatically render a rocket motor non-propulsive when it is dangerously exposed to heat by use of a triggering mechanism which is responsive to exposure to the heat and which cannot be triggered accidently.

It is a further object of the present invention to provide such a means which is rugged, reliable, inexpensive, and adds minimally to rocket motor weight.

In order to render a rocket motor non-propulsive in case of hazardous fire, in accordance with the present invention an explosive charge is provided in contact with the rocket motor case to effect an opening therein upon detonation. The charge is triggered by an electric current provided by a thermocouple which generates the electric current when heated by the fire. While any suitable bridge means may be used, a low power bridge means such as the semiconductor bridge means disclosed in the aforesaid Bickes, Jr. et al patent, which is hereby incorporated herein by reference, is preferred.

Other objects, features, and advantages of the present invention will become apparent in the following detailed description of the preferred embodiments when read in conjunction with the accompanying drawings, in which like reference characters designate the same or similar parts throughout the several views.

DETAILED DESCRIPTION OF THE PREFERRED EMBODIMENTS

Figure 1:
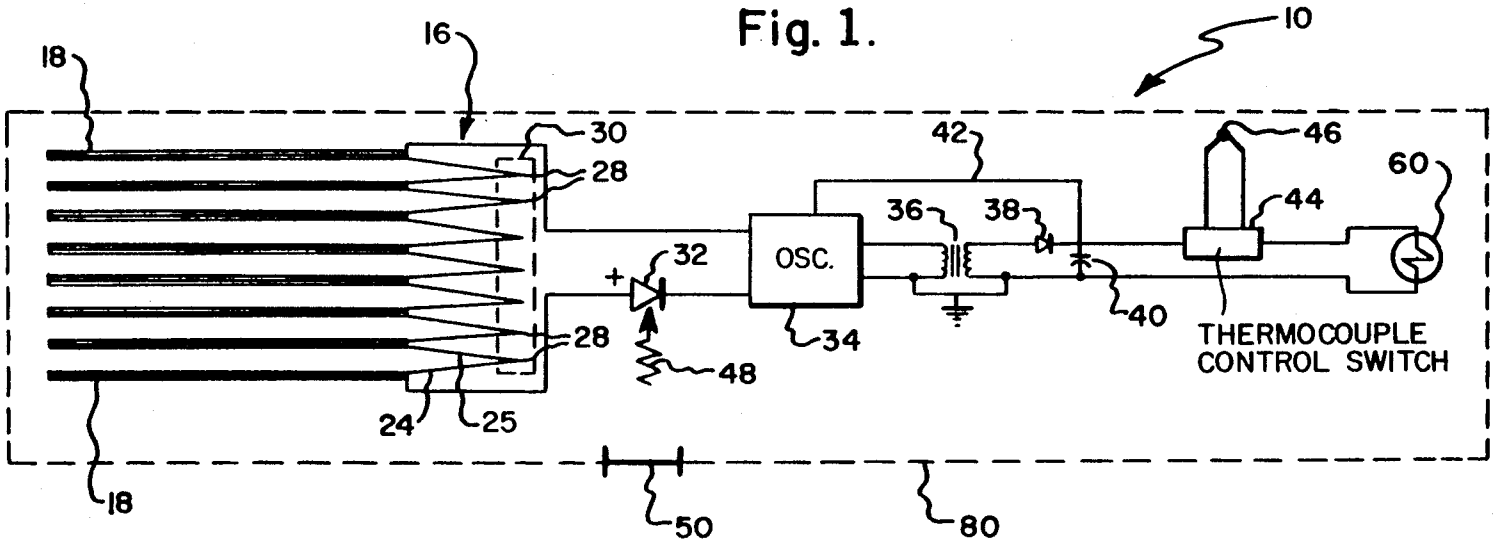
FIG. 1 is a schematic view of an igniter in accordance with the present invention.
Figure 3:
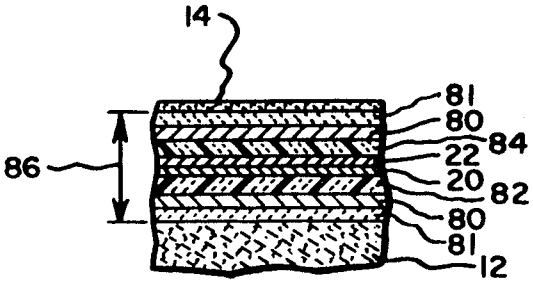
FIG. 3 is an enlarged partial sectional view of a thermocouple foil pair of the igniter of FIG. 1 embedded in a rocket motor case.

Referring to the drawings, there is illustrated at 10 an igniter for pyrotechnic material 26 which, upon ignition, may be caused to ignite a greater amount of pyrotechnic material for igniting an explosive charge. Thus, igniter 10 may be called an explosive "initiator". The igniter 10 may be suitably embedded within the composite case 12 of a rocket motor, as shown in FIG. 3. The igniter 10 is preferably provided close to the outer surface 14 of the case so that it may sense the heat of a fire early for igniting an explosive charge for ripping an opening in the rocket motor case 12 sufficient to render it non-propulsive However, it should be understood that the igniter 10 may have other uses than as shown and described herein and may be positioned otherwise such as in contact with the outer surface of the case.

While it is desirable that a safety mechanism be provided for rendering a rocket motor non-propulsive in case of fire, it is also desirable that the safety mechanism not itself be a hazard such as due to its accidentally being triggered. In order to insure that the igniter 10 is triggered to ignite the pyrotechnic material 26 only upon the application of heat thereto at a dangerously high temperature so that accidental ignition does not take place, in accordance with the present invention the igniter 10 is triggered by a thermocouple 16 which generates electricity only upon the application of heat thereto. As used herein, a "thermocouple" is defined as a device for generating an electric current in which two electrical conductors of dissimilar metals, such as copper and iron, are joined at the point where heat is to be applied and the free ends connected to an electric circuit, and the heat generates a current which flows in the electric circuit.

In order to achieve adequate ignition voltage, the thermocouple 16 is composed of a plurality of perhaps 8 pairs 18 of dissimilar metals, such as a copper layer 20 and a constantan layer 22. In order that the igniter 10 may be compact enough to fit within the windings of a composite rocket motor case 12, the layers 20 and 22 of dissimilar materials are provided as thin foils, and they are positioned in engagement with each other over their surfaces. Each of the foils 20 and 22 may have a surface area of perhaps 0.5 square foot and may perhaps be about 0.001" thick. The pairs 18 of foils may be spaced axially of the rocket motor case 12. However, if desired, they may be spaced or staggered circumferentially around the rocket motor case 12 so as to detect and generate current in response to a hazardous fire on any side thereof.

The individual thermocouple pairs 18 are connected in series, that is, a lead 24 from the constantan foil of each pair is connected to the lead 25 from the copper foil of an adjacent pair at the connections indicated at 28. If the connections 28 are exposed to the heat, a reverse voltage may disadvantageously be effected. In order to prevent such exposure to the heat, the connections 28 are preferably disposed within a suitable insulated enclosure illustrated at 30 to prevent the reverse blocking voltage.

The thermocouple 16 is connected in series with a photodiode 32 to a suitable oscillator 34. The purpose of the photodiode 32 will be described later. Since the thermocouple pairs are spaced or staggered about or along the case, some of them may not be exposed to the heat of a fire. If half of the eight thermocouple pairs 18 are exposed to the heat of a fire, a voltage of perhaps 0.4 volts may be generated. The oscillator 34 is coupled by means of transformer 36 and diode 38 to a capacitor 40 for building up a suitable charge thereon. The voltage provided to the oscillator 34 may drop off when it begins drawing current. In order to maintain the voltage supplied to the capacitor at a suitable level, a feedback loop 42 is provided to the oscillator 34 to provide the control voltages required to turn on and off internal transistors thereof.

The capacitor 40 is connected to bridge 60, which will be described in greater detail hereinafter, for discharging of the charge built up thereon to bridge 60 when thermocouple control switch 44, in series therewith, is closed. The actuator or control mechanism 46 for switch 44 is an RC timing circuit or other suitable conventional comparator which amplifies the thermocouple output voltage and compares the output voltage to the design voltage. When the thermocouple output voltage is equal to the design voltage for a predetermined period of time, comparator 46 closes the switch 44 to shunt the capacitor 40 to the bridge 60. For example, the switch 44 may be set to be closed by the comparator 46 upon its sensing a voltage of 100 millivolts, representing a heat hazard, for a period of 1 minute. This time delay factor prevents heat excursions which are of a temporary nature from triggering the igniter 10.

The photodiode 32 is provided to sense infrared light, illustrated at 48, from a fuel fire to supply additional voltage for insuring that enough voltage is supplied to operate the oscillator 34. The photodiode 32 provides an additional opportunity to detect a fire. The infrared light 48 from a fuel fire passes through window 50 which provides long wave length (infrared) passing properties and blocks visible (and ultraviolet) light and may be of a construction commonly known to those of ordinary skill in the art to which this invention pertains. A plurality of the photodiodes (and associated windows) may be provided in series and spaced about or along the case 12.

External interfering signals such as radio frequency energy, nuclear radiation, and electrostatic discharge may induce sufficient energy into the system to cause the igniter to function inadvertently to ignite the pyrotechnic material if not otherwise suitably protected from such stray currents. In order to prevent any interfering stray or random radiation from inducing voltages or currents in the bridge of a magnitude capable of igniting the pyrotechnic material 26, the igniter 10 preferably includes a housing, illustrated at 80, composed of an electrically conductive material such as a thin metal, for example, steel wherein the housing forms what is commonly called a "Faraday cage".

The amount of electrical energy provided by the thermocouple 16 and/or photodiode 32 may be on the order of 1 to 5 millijoules or less. The pyrotechnic material 26 may, for example, be $TiH_{0.65}/KClO_4$, which is a fine powder oxidizer mixture described in the aforesaid U.S. Pat. No. 4,708,060 to Bickes, Jr. et al, which can initiate various other secondary explosives such as CH-6 (made of RDX, graphite, and a waxy binder).

Figure 2:
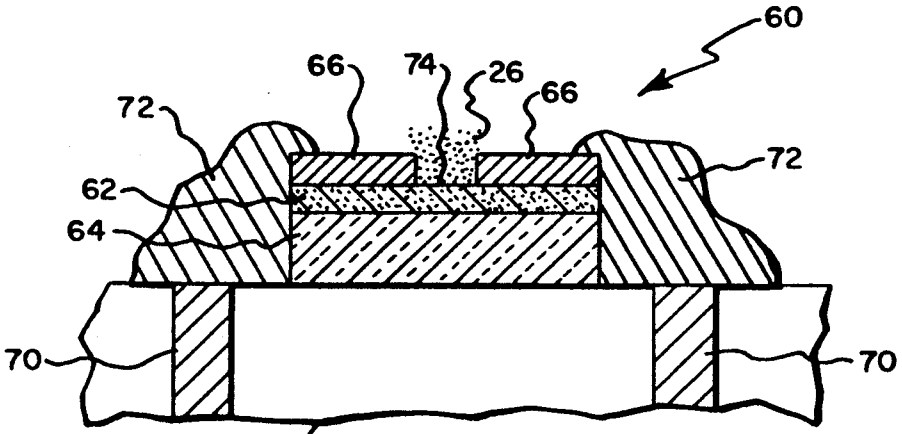
FIG. 2 is a sectional view illustrating a preferred bridge means for the igniter of FIG. 1.

While the bridge 60 may be any device which can be suitably operated with a low excitation energy of 1 to 5 millijoules or less for igniting the pyrotechnic material 26, it is preferably a semiconductor bridge, similar to the semiconductor bridge in Bickes, Jr. et al. Referring to FIG. 2, semiconductor bridge 60 includes a highly doped silicon layer 62 on a sapphire substrate 64. A pair of metallized lands or conducting members 66 cover most of silicon layer 62 and act as electrodes receiving energy discharged from the capacitor 40 The substrate 64 is mounted on a ceramic header 68 having a pair of spaced electrical conductors 70 extending therethrough and connected through solder 72 to the respective conducting members 66. A metal housing (not shown) surrounds the header 68 and holds the pyrotechnic material 26. The conducting members 66 are spaced apart to define a gap therebetween of uncovered silicon material which defines a bridge, illustrated at 74, for passage of the electrical energy discharged from the capacitor 40. The granules of pyrotechnic material 26 are disposed between the conducting members 66 in intimate or closely associated relation with the bridge 74, i.e., the exposed surface of the silicon layer 62. While not wishing to be bound by its theory of operation, as electrical energy is flowed across the bridge 74, it is believed to cause the semiconductor material 62 to heat and form a plasma which ignites the pyrotechnic material 26. The bridge 74 or gap between conducting members 66 is preferably as small as possible yet large enough to allow pyrotechnic material 26 therein for ignition. For example, the gap 74 may have a width of perhaps 0.004". Preferably, the gap should be sufficiently narrow that the resistance to the flow of electric energy along the path 74 is less than about 3 ohms. The semiconductor bridge 60 is described in greater detail in the aforesaid patent to Bickes, Jr. et al.

A typical 1 ohm semiconductor bridge is a heavily n-doped polysilicon area 100 micrometers long by 380 micrometers wide by 2 micrometers thick defined on a 0.6 millimeter thick by 1.5 millimeter square silicon substrate. Two aluminum lands cover most of the n-doped polysilicon area and are contacts for electrical connection of the semiconductor header pins. Semiconductor bridge devices may be mass produced on wafers of the silicon substrate similarly as computer chips are conventionally produced. After the finished wafer (containing hundreds of chips) is diced, the resulting 1.5 millimeter square chips are mounted onto a header. Attachment to headers may be by a tape-automated bonding process commonly used for attaching integrated circuits to circuit boards.

It should be understood that other embodiments of the circuit may be provided to achieve the same result, and such other embodiments are meant to come within the scope of the present invention as claimed in the appended claims. For example, the circuit to which the thermocouple 16 is connected may comprise an energy storage capacitor, a resistor which is selected to control the charge time of the capacitor, a zener diode which conducts when the voltage on the capacitor reaches a desired level, and a silicon-controlled rectifier the gate of which is triggered when the zener diode conducts to allow current to pass through the silicon controlled rectifier to the semiconductor bridge. Because semiconductor bridges may operate at much lower stored energy requirements than conventional hot-wire systems, i.e., perhaps 1/10 as much, the complexity and cost of the firing system may be substantially less. Thus, a semiconductor bridge may advantageously be an order of magnitude less costly than a conventional hot bridge wire device The semiconductor bridge device may also be advantageously relatively insensitive to initiation and electrostatic discharge safe.

FIG. 3 is an enlarged view of a pair of the foils 20 and 22 embedded in the rocket motor case 12 and close to the outer surface 14 thereof, i.e., beneath perhaps one or two layers of resin impregnated fibrous material of which the composite case is composed. A pair of layers 82 and 84 of insulator material separate the foils 20 and 22 respectively from the shield 80. For example, the layers 82 and 84 may be composed of Kapton polyimide film, a product of E. I. DuPont de Nemours and Company of Wilmington, Del. The shield 80 may also be provided with a protective covering 81 such as, for example, Kapton polyimide film or Mylar material, between the shield 80 and case 12. The thickness, illustrated at 86, of the assembly of a pair of thermocouple layers within the shield may be perhaps 5 mils. The electronic components and charge may be contained within a box at the head end of the rocket motor at a suitable position for forming a suitable opening therein upon detonation.

While specific embodiments of the invention have been shown and described in detail to illustrate the application of the principles of the invention, it is understood that the invention may be embodied otherwise without departing therefrom, and the details herein are therefore to be interpreted as illustrative and not in a limiting sense. Such other embodiments are meant to come within the scope of the present invention as claimed in the appended claims.

What is claimed is:

1. An igniter comprising an ignitable material, means for igniting said ignitable material in response to electrical energy, thermocouple means for generating electrical energy, electric circuit means for supplying electrical energy generated by said thermocouple means to said igniting means said circuit means including an oscillator means and at least one photodiode in series with said thermocouple means and responsive to infrared light to provide voltage in addition to voltage provided by said thermocouple means for operating said oscillator means.

2. An igniter according to claim 1 wherein said electric circuit means comprises a capacitor, oscillator means for charging said capacitor, and switch means which closes for shunting voltage on said capacitor to said igniting means, said switch means being responsive to a comparator means for closing upon occurrence of a predetermined thermocouple means output voltage for a predetermined period of time.

3. An igniter according to claim 1 further comprising an electrically conductive housing means for protecting the igniter from external electrostatic interference and at least one window means in said housing means to pass infrared light to said photodiode and to block visible and ultraviolet light.

4. An igniter according to claim 1 further comprising an electrically conductive housing means for protecting the igniter from external electrostatic interference.

5. An igniter according to claim 1 wherein said thermocouple means comprises at least one pair of foils of dissimilar metals joined along their planar surfaces.

6. An igniter according to claim 1 wherein said thermocouple means comprises a plurality of pairs of foils of dissimilar metals joined along their planar surfaces and connected in series and heat insulation means for housing the connections of the plurality of pairs of foils.

7. An igniter comprising an ignitable material, semiconductor bridge means for igniting said ignitable material in response to electrical energy, thermocouple means for generating electrical energy, electric current means for supplying electrical energy generated by said thermocouple means to said semiconductor bridge means, said circuit means including an oscillator means and at least one photodiode in series with said thermocouple means and responsive to infrared light to provide voltage in addition to voltage provided by said thermocouple means for operating said oscillator means.

8. An igniter according to claim 7 wherein said electric circuit means comprises a capacitor, oscillator means for charging said capacitor, and switch means which closes for shunting voltage on said capacitor to said semiconductor bridge means, said switch means being responsive to a comparator means for closing upon occurrence of a predetermined thermocouple means output voltage for a predetermined period of time.

9. A method for rendering a rocket motor non-propulsive in case of fire comprising embedding a thermocouple means in the rocket motor case, and providing an electric circuit between the thermocouple means and an igniting device for supplying electrical energy generated by the thermocouple means to the igniting device for forming an opening in the rocket motor case.

10. A method according to claim 9 comprising composing the thermocouple means of at least one pair of foils of dissimilar metal and joining the foils along their planar surfaces.

11. A method according to claim 9 further comprising selecting the igniting device to be a semiconductor bridge.

12. A method according to claim 9 comprising providing a plurality of thermocouples connected in series and providing heat insulation for the connections.

13. A method according to claim 12 further comprising selecting the igniting device to be a semiconductor bridge.

14. A method according to claim 9 further comprising constructing the circuit to have a capacitor, an oscillator for charging the capacitor, and a switch for shunting voltage on the capacitor to the igniter, the switch being responsive to a comparator for closing upon occurrence of a predetermined thermocouple means output voltage for a predetermined period of time.

15. A method according to claim 9 further comprising providing at least one photodiode in series with the thermocouple means for providing additional electrical energy in response to infrared light.

16. A method according to claim 15 further comprising enclosing the igniter with an electrically conductive housing for protecting the igniter from external electrostatic interference and providing at least one window in the housing for passing infrared light to the photodiode and for blocking visible and ultraviolet light.

* * * * *